US007855495B2

(12) United States Patent
Handa

(10) Patent No.: US 7,855,495 B2
(45) Date of Patent: Dec. 21, 2010

(54) MAGNETRON WITH RELATIVELY FIXED YOKE AND COOLING BLOCK BY MEANS OF A CUSHIONING MATERIAL AND FIXING MEMBER

(75) Inventor: Takanori Handa, Tochigi (JP)

(73) Assignee: Panasonic Corporation, Osaka (JP)

( * ) Notice: Subject to any disclaimer, the term of this patent is extended or adjusted under 35 U.S.C. 154(b) by 412 days.

(21) Appl. No.: 12/109,912

(22) Filed: Apr. 25, 2008

(65) Prior Publication Data

US 2009/0039753 A1 Feb. 12, 2009

(30) Foreign Application Priority Data

Aug. 8, 2007 (JP) ..... P. 2007-207060

(51) Int. Cl.
*H01J 1/50* (2006.01)
*H01J 7/24* (2006.01)
*H01J 25/50* (2006.01)

(52) U.S. Cl. ..... 313/153; 313/160; 315/39.51; 315/39.63; 315/39.67; 315/39.71

(58) Field of Classification Search ..... 313/153–162, 313/35, 36, 44, 46; 315/39.51–39.77
See application file for complete search history.

(56) References Cited

U.S. PATENT DOCUMENTS 4,395,657 A * 7/1983 Tada et al. ..... 315/39.71
5,334,302 A * 8/1994 Kubo et al. ..... 204/298.18
5,508,583 A * 4/1996 Lee ..... 315/39.51

FOREIGN PATENT DOCUMENTS

JP 03-297034 12/1991
JP 04-284334 A 10/1992
JP 09205243 A * 8/1997
JP 2000-285817 A 10/2000

OTHER PUBLICATIONS

Extended European Search Report issued in European Patent Application No. EP 08 15 4702.8 dated Jan. 28, 2010.

* cited by examiner

*Primary Examiner*—Mariceli Santiago
(74) *Attorney, Agent, or Firm*—McDermott Will & Emery LLP

(57) ABSTRACT

A gap is provided between a cooling block 22 and a magnetic yoke 20. A cushioning material 25 is interposed in the gap to fix the cooling block 22 relatively to the magnetic yoke 20 by screws. Thus, even when metals having a large difference in tendency of ionization are used in the cooling block 22 and the magnetic yoke 20, the corrosion of the metals hardly arises. Further, the cushioning material 25 is provided in the gap between the cooling block 22 and the magnetic yoke 20, so that an impact or vibration to an anode tubular member 10 can be mitigated and the disconnection and deficiency of the filament of a cathode structural member can be reduced. Further, since a dimensional unevenness of the cooling block 22 or the magnetic yoke 20 can be absorbed by the cushioning material 25, the dimensional accuracy of parts does not need to be improved to make an assembly easy.

5 Claims, 11 Drawing Sheets

MAGNETRON WITH RELATIVELY FIXED YOKE AND COOLING BLOCK BY MEANS OF A CUSHIONING MATERIAL AND FIXING MEMBER

BACKGROUND OF THE INVENTION

1. Field of the Invention

The present invention relates to a magnetron preferably applied to a device using a microwave such as a microwave oscillator.

2. Description of the Related Art

FIG. 17 is a longitudinally sectional view showing a magnetron disclosed in Patent Document 1. The magnetron shown in FIG. 17 mainly includes a magnetic yoke 4, an output part 9 provided in the upper part of the magnetic yoke 4 and a filter 11 provided in the lower part of the magnetic yoke 4. In the magnetic yoke 4, two annular permanent magnets 8A and 8B, an anode tubular member 10 and a cooling block 1 for covering the periphery of the anode tubular member 10 are accommodated. The filter 11 is provided with a choke coil 6 and a through capacitor 7.

The magnetic yoke 4 includes a main body part 4*a* with a form having one end (a lower end in FIG. 17) opened, the other end (an upper end in FIG. 17) closed and a hole (an illustration is omitted) opened at a central part and a cover part 4*b* for closing the opened end of the main body part 4*a*. In the central part of the cover part 4*b*, a hole is opened (an illustration is omitted) that is the same as the hole opened in the main body part 4.

The cooling block 1 is made of metal having a high thermal conductivity. In the cooling block, a cooling liquid circulating pipeline 2 for cooling liquid is formed. In the cooling liquid circulating pipeline 2, the cooling liquid is circulated. In the anode tubular member 10, anode vanes 12 are arranged in radial directions and a cavity resonator is formed by a space surrounded by the respectively adjacent anode vanes 12 and the anode tubular member 10. Further, in the central part of the anode tubular member 10, a cathode structural member 13 is disposed. A space surrounded by the cathode structural member 13 and the anode vanes 12 serves as a working space. On an upper end of the anode tubular member 10, an output side pole piece 14 is fixed and, to a lower end, an input side pole piece 15 is fixed.

The anode tubular member 10 is pressed from outside the annular permanent magnets 8A and 8B disposed in both upper and lower ends by the magnetic yoke 4. The annular permanent magnet 8B disposed in the lower side in of the drawing is a magnet of an input side and the annular permanent magnet 8A disposed in the upper side is a magnet of an output side.

The cooling block 1 serves to cool the anode tubular member 10 and its inner wall surface comes into closely contact with the outer wall surface of the anode tubular member 10 and its outer wall surface comes into closely contact with the inner wall surface of the magnetic yoke 4. A thermal diffusion compound 3 is applied to a contact part of the outer wall surface of the cooling block 1 and the inner wall surface of the magnetic yoke 4. Thus, if a gap should be formed in the contact part, a good thermally conductive state would be obtained and both the cooling block and the magnetic yoke could be secured to each other. In such a way, the cooling block 1 can cool the anode tubular member 10, the magnetic yoke 4, and the annular permanent magnets 8A and 8B and the filter 11 through the magnetic yoke 4.

When the usual magnetron is used, after the inner part of the magnetron is brought to a vacuum state, a desired electric power is applied to the cathode structural member 13 to discharge a thermo-electron and a dc high voltage is applied to a part between the anode vanes 12 and the cathode structural member 13. In the working space, a magnetic field is formed by the two annular permanent magnets 8 in the direction at right angles to the opposed direction of the cathode structural member 13 and the anode tubular member 10. The dc high voltage is applied to the part between the anode vanes 12 and the cathode structural member 13 so that electrons emitted from the cathode structural member 13 are pulled out toward the anode vanes 12. The electrons turn and circulate by an electric field and the magnetic filed in the working space to reach the anode vanes 12. Energy by the movement of the electrons is applied to the cavity resonator to contribute to the oscillation of the magnetron.

Patent Document 1: JP-A-3-297034

However, the above-described usual magnetron has below-described problems.

Since the cooling block 1 comes into closely contact with the magnetic yoke 4, the cathode structural member 13 of the anode tubular member 10 is weak to an external impact as well as a vibration. In the cathode structural member 13, a filament for emitting electrons is provided. Since the filament has a quality very weak to the vibration or the impact and may be disconnected depending on the level of an external force or the vibration. When the filament is disconnected, the magnetron does not function.

Further, since the cooling block 1 is allowed to come into closely contact with the magnetic yoke 4, when the dimensional accuracy of them is not improved, an assembly is difficult. Even when these members can be assembled, if a gap between the cooling block 1 and the magnetic yoke 4 is large, an adhesion of the cooling block 1 and the magnetic yoke 4 is hardly improved even by applying the thermal diffusion compound 3.

Further, a corrosion (rust) may arise in a part where the cooling block 1 comes into closely contact with the magnetic yoke 4 depending on a material. For instance, when copper is used as a material of the cooling block, a difference in tendency of ionization becomes large between the magnetic yoke using iron and the cooling block, so that the magnetic yoke made of iron or (zinc) corrodes. In the liquid cooling type magnetron, since a dew condensation is apt to arise, the corrosion due to the difference in tendency of ionization is more accelerated. As examples that the difference in tendency of ionization is increased, copper and zinc, aluminum and iron and aluminum and zinc are exemplified as well as copper and iron.

SUMMARY OF THE INVENTION

The present invention is devised by considering the above-described circumstances, and it is an object of the present invention to provide a magnetron that is excellent in its impact resistance and vibration resistance and easy in its assembly even when there is unevenness in dimension of a cooling block or a magnetic yoke and hardly generates a corrosion of metal.

A magnetron comprises: a cooling block that cools an anode tubular member having a cathode structural member and a magnetic yoke that accommodates the cooling block. A gap is provided between the cooling block and the magnetic yoke and a cushioning material is provided in the gap to fix the cooling block and the magnetic yoke relatively by a fixing member.

According to the above-described structure, the gap is provided between the cooling block and the magnetic yoke and the cushioning material is interposed between the cooling block and the magnetic yoke, so that the cushioning member can serve as a damper for the external impact or the vibration. Thus, the impact or the vibration to the cathode structural member of the anode tubular member can be mitigated and the disconnection or deficiency of the filament of the cathode structural member due to the impact or the vibration can be reduced. Further, since the cooling lock does not come into contact with the magnetic yoke, even when metals having a large difference in tendency of ionization (for instance, copper and iron (zinc), aluminum and iron (zinc), aluminum and copper or the like) are used for the cooling block and the magnetic yoke, the corrosion of the metals hardly arises. Further, since the anode cylinder is fixed to the cooling block and the cooling block is fixed relatively to the magnetic yoke, the anode cylinder can be prevented from rotating relative to the magnetic yoke.

Further, since the gap is provided between the cooling block and the magnetic yoke, even when there is dimensional unevenness in the cooling block or the magnetic yoke, the above-described cushioning material absorbs it. Accordingly, the dimensional accuracy of parts may not be required. Thus, since the number of processes for improving the accuracy of the parts is not necessary, a cost can be the more lowered. Further, since the size of the cooling block can be made to be smaller than that of a usual cooling block, the cost can be also lowered. Further, since the cooling block does not come into contact with the magnetic yoke, unevenness in temperature of the magnetic yoke of the magnetron owing to a degree of contact does not arise and a prescribed quality can be maintained. Further, when a control is carried out in accordance with the temperature of the magnetic yoke, even if a temperature sensor is applied to any of parts of the magnetic yoke, a substantially equal temperature measured result is obtained. Thus, a highly accurate control can be realized.

Further, since the cooling block is fixed relatively to the magnetic yoke by the fixing member, even when a fixing member such as a screw for attaching the cooling block to the anode tubular member is unfastened, the cooling block can be prevented from being slipped off.

Further, in the above-structure, the cushioning material is interposed between the fixing member and the magnetic yoke to relatively fix the cooling block and the magnetic yoke by the fixing member.

According to the above-described structure, since the cushioning material is interposed between the fixing member and the magnetic yoke, an impact or vibration to the cathode structural member of the anode tubular member can be mitigated and the disconnection or deficiency of the filament of the cathode structural member owing to the impact or vibration can be reduced.

Further, in the above-described structure, the cushioning material is formed to be longer than the thickness of the magnetic yoke, the magnetic yoke has a hole formed with a size through which the cushioning material can be inserted, and under a state that a part of the cushioning material is inserted into the hole, the cooling block is relatively fixed to the magnetic yoke through the cushioning material.

According to the above-described structure, since the cushioning material is formed to be longer than the thickness of the magnetic yoke, and under a state that a part of the cushioning material is inserted into the hole formed in the magnetic yoke, the cooling block is relatively fixed to the magnetic yoke through the cushioning material, even when the impact is applied to or the vibration is transmitted to the magnetic yoke, the transmission of the impact or the vibration to the cooling block can be effectively mitigated. Especially, when the cooling block is fixed relatively to the magnetic yoke by using the fixing member such as a screw, a rivet, a push pin, an anchor bolt or the like, since an area where the fixing member comes into contact with the magnetic yoke can be made to be zero or minimized, the impact or vibration transmitted to the cooling block from the magnetic yoke through the fixing member can be reduced.

Further, in the above-described structure, the cushioning material serves also as the fixing member.

According to the above-described structure, since the cushioning material serves also as the fixing member, the fixing member such as the screw, the rivet, the push pin, the anchor bolt or the like is not prepared so that the cost can be decreased.

Further, a device using a microwave of the present invention includes the magnetron according to the present invention.

According to the above-described structure, the impact resistance and the vibration resistance can be improved, the cost can be lowered and a stable operation can be realized for a long time.

According to the present invention, the magnetron can be provided that is excellent in its impact resistance and vibration resistance and easy in its assembly even when there is unevenness in dimension of the cooling block or the magnetic yoke and hardly generates the corrosion of metal.

DESCRIPTION OF THE PREFERRED EMBODIMENTS

Figure 1:
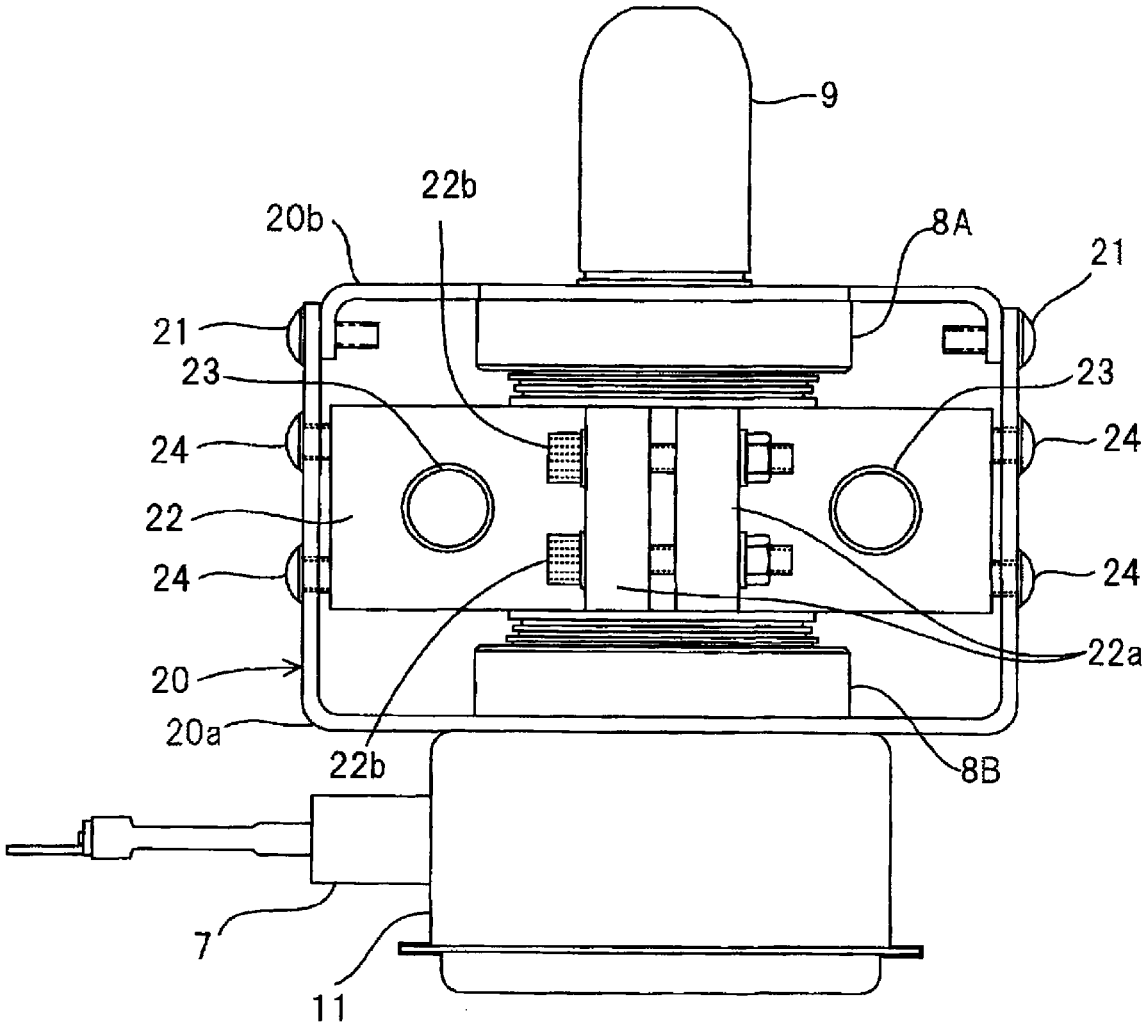
FIG. 1 is a side view showing a magnetron according to one embodiment of the present invention.

Now, a preferred embodiment for embodying the present invention will be described below in detail by referring to the drawings.

Figure 17:
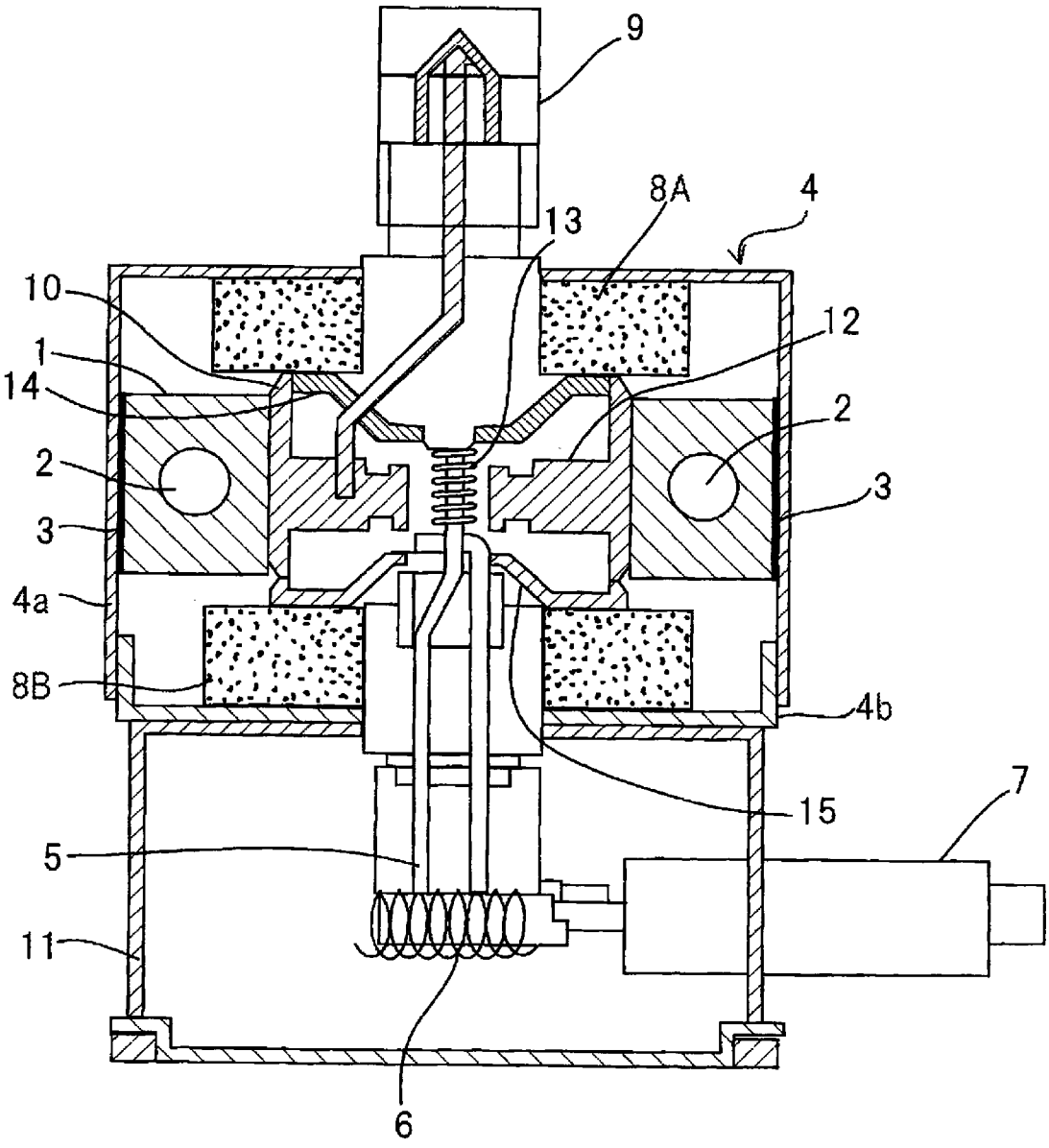
FIG. 17 is a longitudinally sectional view of a usual magnetron.

FIG. 1 is a side view showing a magnetron according to one embodiment of the present invention. In FIG. 1, parts the same as those of FIG. 17 are designated by the same reference numerals. Further, in FIG. 1, an inner part of a magnetic yoke 20 is seen so that the relation between the magnetic yoke 20 and a cooling block 22 can be easily understood. The magnetic yoke 20 has a substantially same structure as that of the above-described magnetic yoke 4 shown in FIG. 17. However, a positional relation of a main body part 20*a* and a cover part 20*b* of the magnetic yoke 20 is inverted. That is, the magnetic yoke 20 includes the main body part 20*a* with a form having one end (an upper end in FIG. 1) opened, the other end (a lower end in FIG. 1) closed and a hole (an illustration is omitted) opened at a central part and the cover part 20*b* for closing the opened end of the main body part 20*a*. In the central part of the cover part 20*b*, a hole is opened (an illustration is omitted) that is the same as the hole opened in the main body part 20*a*. The main body part 20*a* is connected to the cover part 20*b* by screws 21.

In the magnetic yoke 20, two annular permanent magnets 8*a* and 8B, an anode tubular member 10 (see FIG. 17) and a cooling block 22 for covering the periphery of the anode tubular member 10 are accommodated.

The cooling block 22 has fastening parts 22*a* in parts thereof and is mounted on the anode tubular member 10 (see FIG. 17) and then fixed to the anode tubular member 10 by fastening screws 22*b* of the fastening parts 22*a*. The cooling block 22 is set so that a gap is formed between the magnetic yoke 20 and the cooling block 22 when the cooling block is fixed to the anode tubular member 10. In the cooling block 22, a cooling liquid circulating pipeline 23 is formed for circulating cooling liquid and the cooling liquid is supplied to the cooling liquid circulating pipeline 23.

Figure 2:
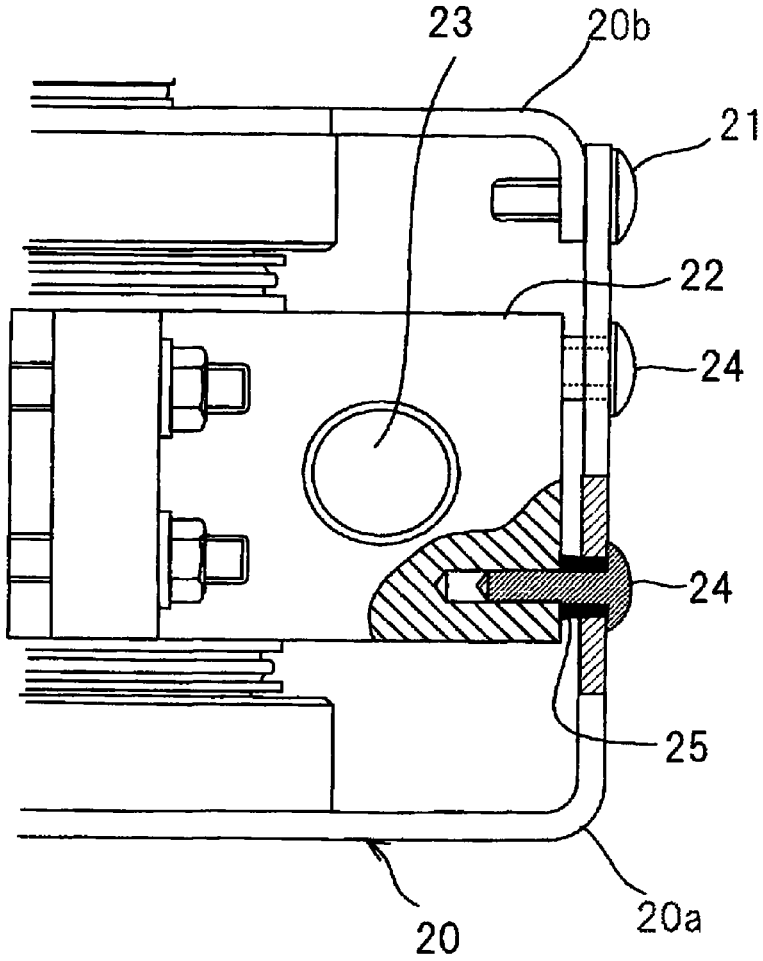
FIG. 2 is a sectional view showing a connecting part of a cooling block and a magnetic yoke of the magnetron according to the one embodiment of the present invention.
Figure 3:
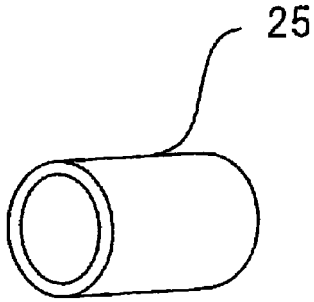
FIG. 3 is a view showing a cushioning material of the magnetron according to the one embodiment of the present invention.

As shown in a partly sectional view of FIG. 2, the cooling block 22 is connected to the magnetic yoke 20 by screws 24. In this case, between the cooling block 22 and the magnetic yoke 20, a cylindrical cushioning material 25 shown in FIG. 3 is provided and the magnetic yoke is screwed to the cooling block through the cushioning materials 25. The cushioning material 25 is formed with a length from the outer side surface of the magnetic yoke 20 to the surface of the cooling block 22. As a material of the cushioning material 25, a resin material excellent in its impact resistance and vibration resistance such as nylon, Teflon (a registered trademark), Juracon (a registered trademark), urethane, rubber or the like is preferable.

In the magnetic yoke 20, holes into which the screws 24 are inserted are formed. The hole has such a size as to insert the cushioning material 25. A tapped hole formed in the cooling block 22 has such a size so that the screw 24 can be attached.

Figure 4:
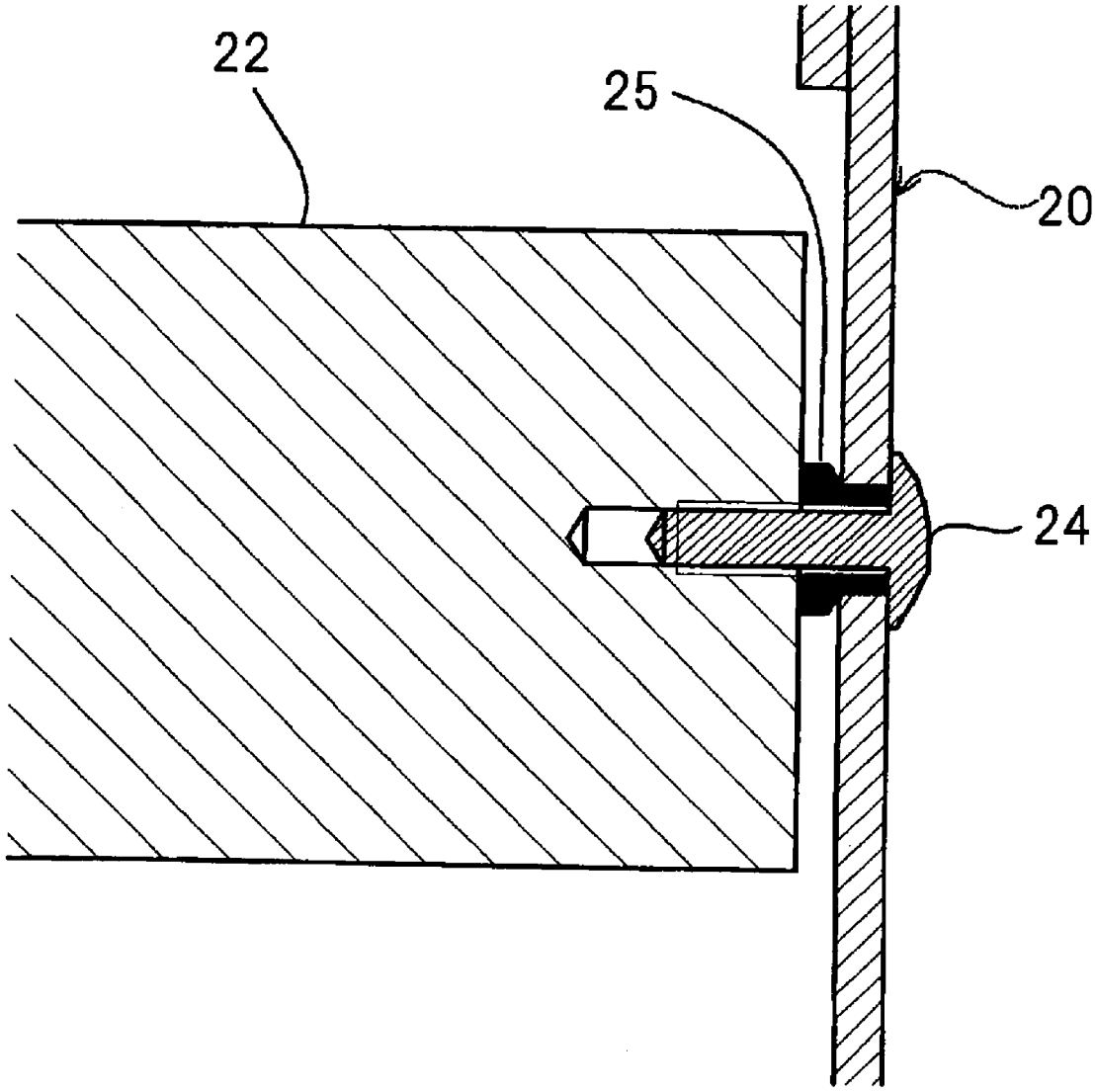
FIG. 4 is a sectional view showing a connecting part of the cooling block and the magnetic yoke of the magnetron according to the one embodiment of the present invention.
Figure 5A:
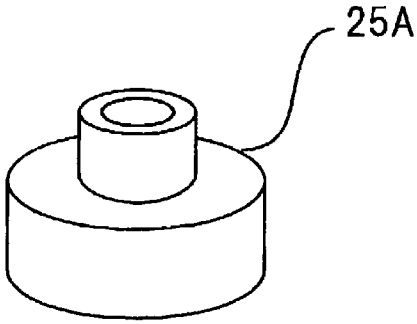
FIG. 5 is a view showing applied examples of the cushioning material of the magnetron according to the one embodiment of the present invention.
Figure 5B:
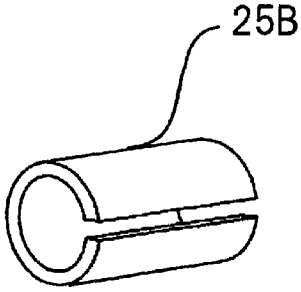
Figure 5C:
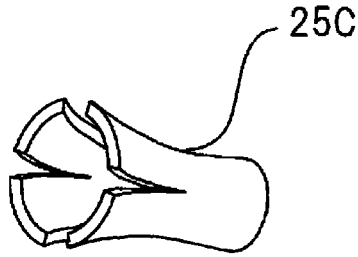
Figure 5D:
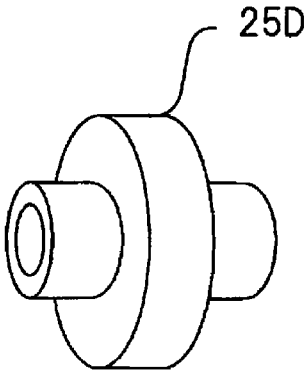
Figure 5E:
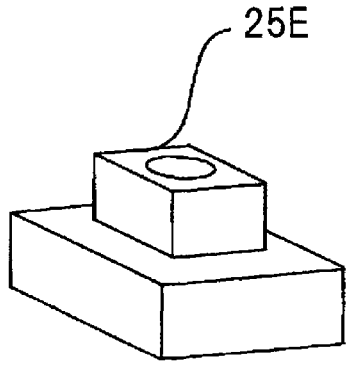

The screws 24 and the cushioning materials 25 are used to fix the cooling block 22 to the magnetic yoke 20 while the gap between the cooling block 22 and the magnetic yoke 20 is maintained. At this time, when the screw 24 is fastened, pressure is applied to a part of the cushioning material 25 between the cooling block 22 and the magnetic yoke 20, so that, as shown in a sectional view of FIG. 4, that part collapses to be widened and enters the gap between the cooling block 22 and the magnetic yoke 20. The collapsing and widened part effectively serves as a damper relative to an external impact or a vibration so that the impact or the vibration to a cathode structural member 13 (see FIG. 17) of the anode tubular member 10 can be mitigated. Thus, the disconnection or deficiency of the filament of the cathode structural member 13 owing to the impact or vibration can be reduced.

Figure 8:
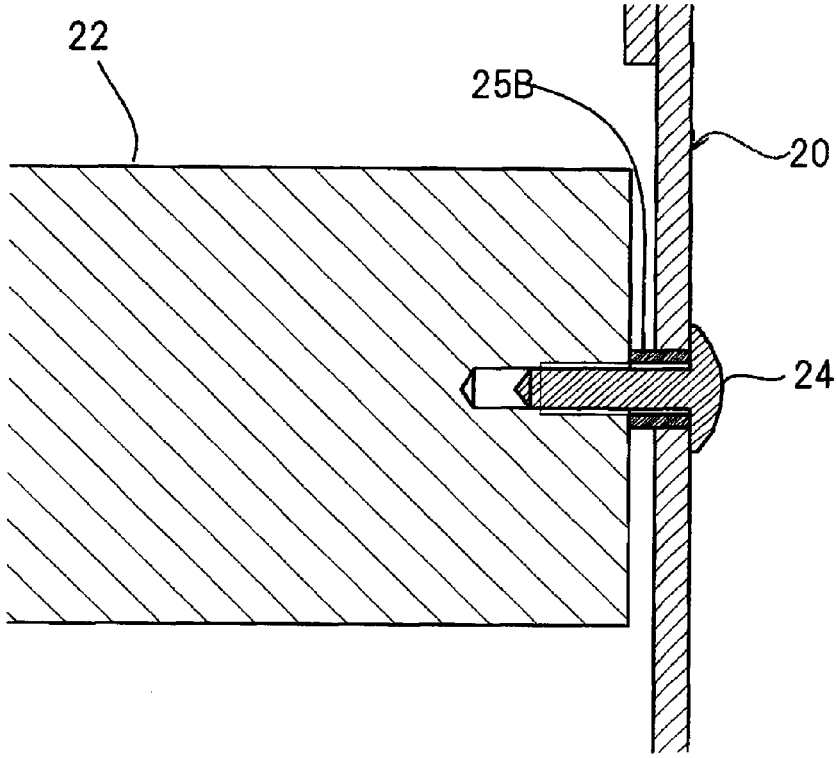
FIG. 8 is a sectional view showing a connecting part of the cooling block and the magnetic yoke when the applied example of the cushioning material of the magnetron according to the one embodiment of the present invention is used.

A degree of collapse of the cushioning material 25 depends on the hardness of the cushioning material 25. When a plurality of slits are provided in the end part of the cushioning material 25 in the cooling block 22 side, the degree of collapse can be more increased (see FIG. 5(*c*)). The collapsing and widened part makes it possible to more increase the impact resistance and the vibration resistance. As shown in a sectional view of FIG. 8, even when the cushioning material 25 is not allowed to collapse by fastening the screw 24, the effect of the cushioning material as the damper is not lost. Further, the vibration and the impact can be mitigated not only by the gap between the cooling block 22 and the magnetic yoke 20, but also by inserting a part of the cushioning material 25 into the hole formed in the magnetic yoke 20.

The above-described example is shown that the form of the cushioning material 25 is cylindrical, however, the form is not limited to a cylindrical form. In FIG. 5, modified examples of the cushioning material 25 are shown. A cushioning material 25A shown in FIG. 5(*a*) is composed of two cylindrical parts having different diameters. A cushioning material 25B shown in FIG. 5(*b*) is formed in a cylindrical form by rounding a plate shaped cushioning material. Further, a cushioning material 25C shown in FIG. 5(*c*) is formed in a cylindrical form having a plurality of slits formed at one end part thereof as described above. Further, a cushioning material 25D shown in FIG. 5(*d*) is formed with a central part having a large diameter and parts of the same configurations with smaller diameters than that of the central part at both ends thereof the central part. Further, a cushioning material 25E shown in FIG. 5(*e*) is formed with two angular parts having different sizes.

Figure 6:
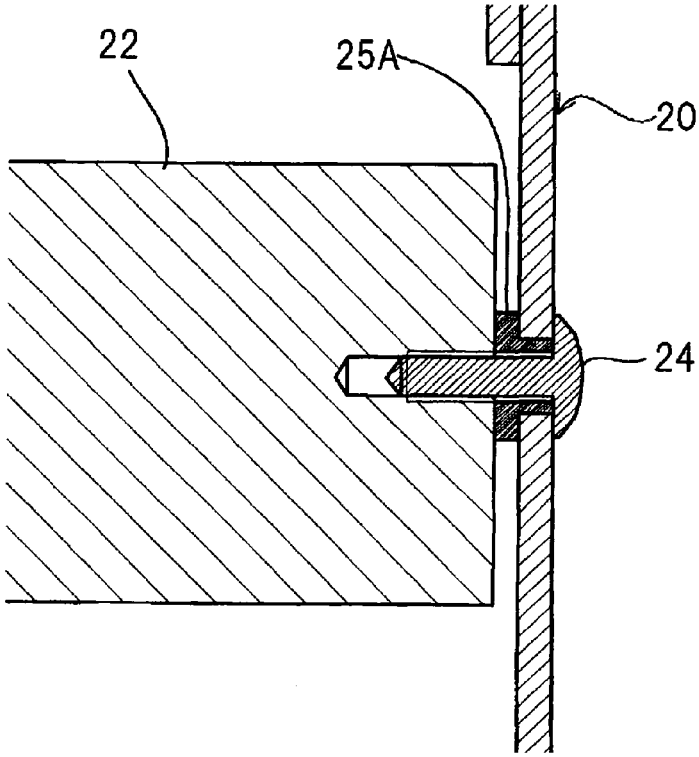
FIG. 6 is a sectional view showing a connecting part of the cooling block and the magnetic yoke when the applied example of the cushioning material of the magnetron according to the one embodiment of the present invention is used.
Figure 7:
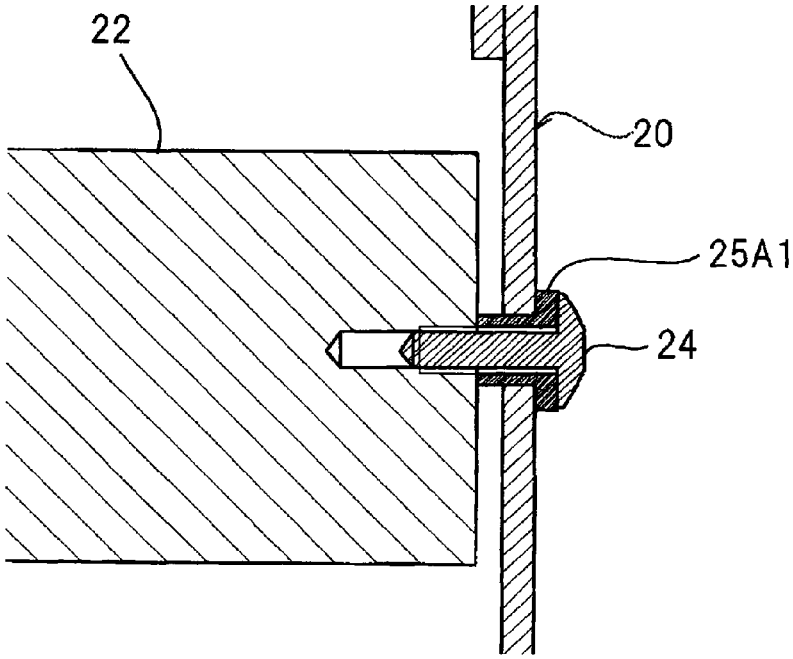
FIG. 7 is a sectional view showing a connecting part of the cooling block and the magnetic yoke when the applied example of the cushioning material of the magnetron according to the one embodiment of the present invention is used.

FIG. 6 is a sectional view showing a connection of the cooling block 22 and the magnetic yoke 20 when the cushioning material 25A shown in FIG. 5(*a*). When the cushioning material 25E shown in FIG. 5(*e*) is used, a section is the same as that of FIG. 6. FIG. 7 is a sectional view showing a connection of the cooling block 22 and the magnetic yoke 20 when a cushioning material 25A1 having the substantially same form as that of the cushioning material 25A shown in FIG. 5(*a*) is used. This cushioning material 25A1 is formed in such a way that a small diameter part thereof has a length extending from the outer side surface of the magnetic yoke 20 to the outer side surface of the cooling block 22.

Figure 9:
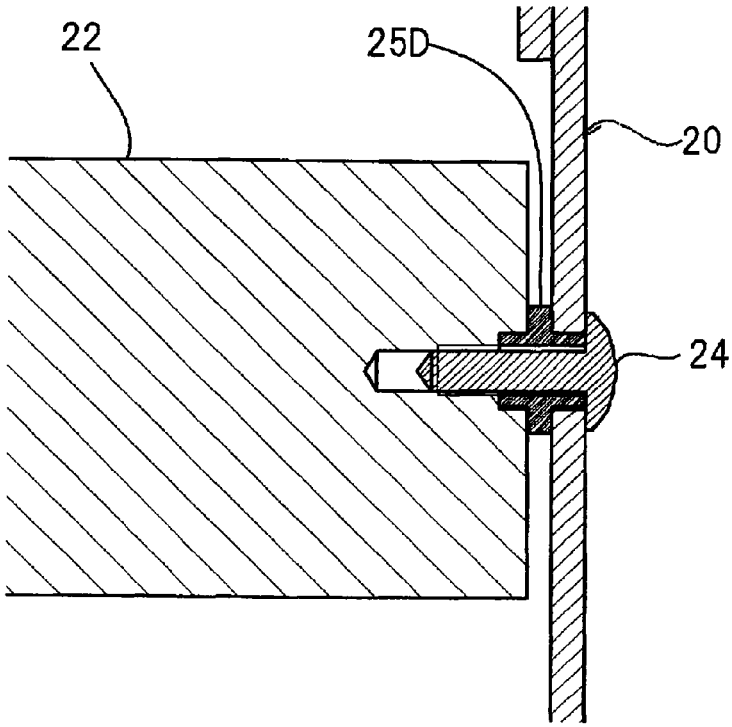
FIG. 9 is a sectional view showing a connecting part of the cooling block and the magnetic yoke when the applied example of the cushioning material of the magnetron according to the one embodiment of the present invention is used.

FIG. 9 is a sectional view showing a connection of the cooling block 22 and the magnetic yoke 20 when the cushioning material 25D shown in FIG. 5(*d*) is used. When the cushioning material 25D is used, in the magnetic yoke 20, a hole into which one small diameter part of the cushioning material 25D can be inserted is formed, and in the cooling block 22, a hole into which the other small diameter part of the cushioning material 25D can be inserted is formed.

Figure 10:
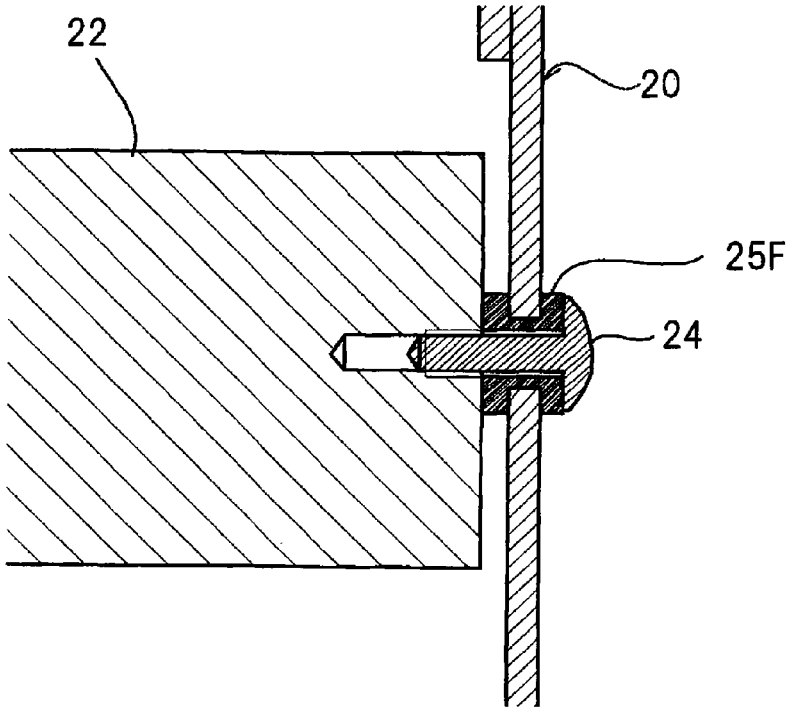
FIG. 10 is a sectional view showing a connecting part of the cooling block and the magnetic yoke when the applied example of the cushioning material of the magnetron according to the one embodiment of the present invention is used.

FIG. 10 is a sectional view showing a connection of the cooling block 22 and the magnetic yoke 20 when a cushioning material 25F having an inverted form of the cushioning material 25D shown in FIG. 5(*d*) is used. Since both end parts of the cushioning material 25F are larger than the hole formed in the magnetic yoke 20, as a material used for the cushioning material, a soft elastic material such as rubber is preferable. When a hard material is used as the material for the cushioning material, the material may be divided at its central part, one part may be fitted to the magnetic yoke from outside the magnetic yoke 20 and the other may be fitted from inside the magnetic yoke 20.

Since the gap is provided between the cooling block 22 and the magnetic yoke 20, even when metals (for instance, copper and iron (zinc), aluminum and iron (zinc), aluminum and copper or the like) having a large difference in tendency of ionization are used for the cooling block 22 and the magnetic yoke 20, the corrosion of the metals hardly arise.

Further, since the gap is provided between the cooling block 22 and the magnetic yoke 20, even when there is a dimensional unevenness in the cooling block 22 and the magnetic yoke 20, the cushioning material 25 can absorb it. Thus, a dimensional accuracy of parts may not be required. Accordingly, the number of processes for improving the accuracy of the parts is not necessary, so that a cost can be the more lowered. Further, since the size of the cooling block 22 can be made to be smaller than that of a usual cooling block, the cost can be also decreased.

Further, since the cooling block 22 is fixed to the magnetic yoke 20 by the screws 24, even when the fastening parts 22*a* are unfastened by a thermal stress or vibration, the cooling block 22 can be prevented from being slipped off. Further, since the cooling block 22 does not come into contact with the magnetic yoke 20, unevenness in temperature of the magnetic yoke 20 due to a degree of contact does not arise and a prescribed quality can be maintained. Further, when a control is carried out in accordance with the temperature of the magnetic yoke, if a temperature sensor is applied to any of parts of the magnetic yoke, a substantially equal temperature measured result is obtained, so that an accurate control can be realized.

Figure 11:
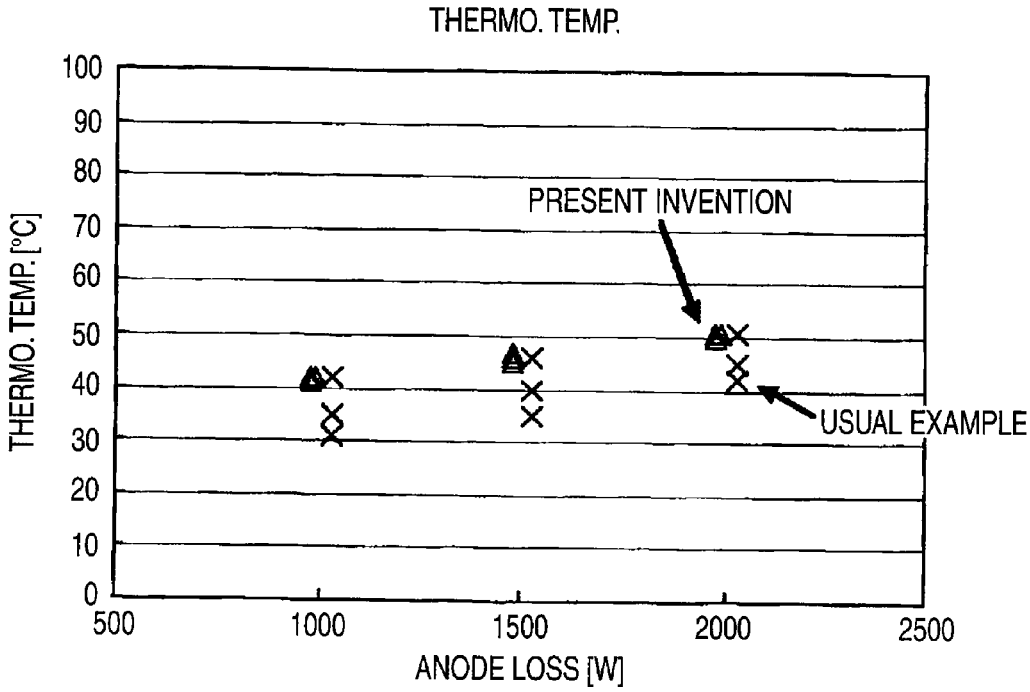
FIG. 11 is a diagram showing the temperature of the magnetic yokes of the magnetron of the present invention and a usual magnetron respectively.
Figure 12:
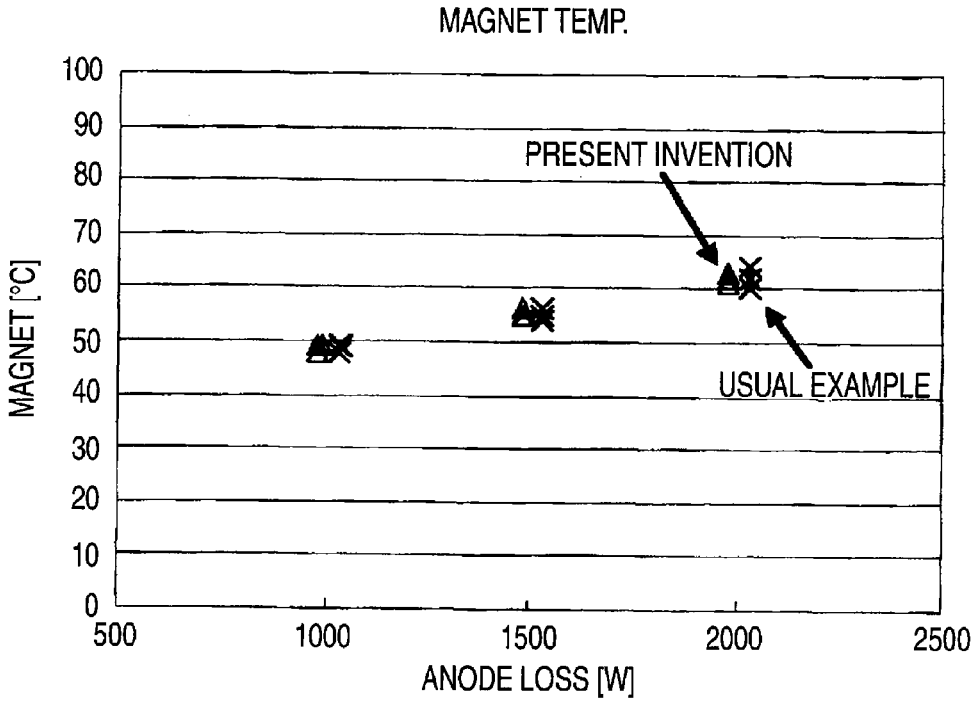
FIG. 12 is a diagram showing the temperature of annular permanent magnets of input sides of the magnetron of the present invention and the usual magnetron respectively.
Figure 13:
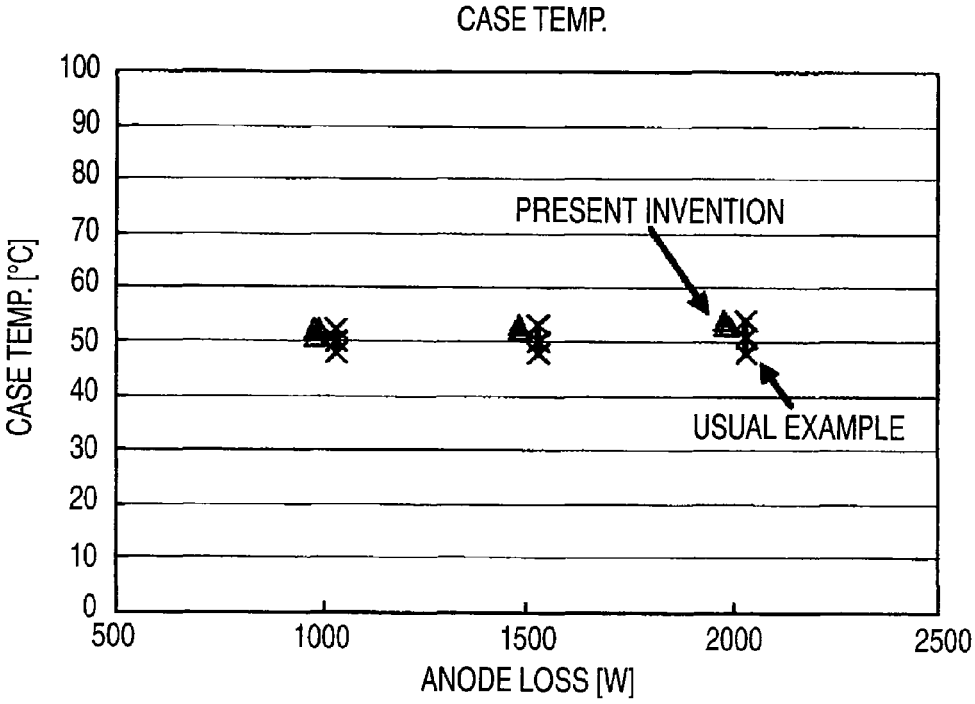
FIG. 13 is a diagram showing the temperature of filters of the magnetron of the present invention and the usual magnetron respectively.

FIGS. 11 to 13 show the difference of the temperature between the magnetron of the present invention and three usual magnetrons in respective parts. FIG. 11 is a graph showing the temperature (Thermo. Temp.) of the magnetic yoke 20. FIG. 12 is a graph showing the temperature (Magnet Temp.) of the annular permanent magnet 8B of an input side. FIG. 13 is a graph showing the temperature (Case Temp.) of a filter 11. In the graphs respectively, an axis of abscissa shows an anode loss.

As shown in FIG. 11, in the usual magnetron, the unevenness arises in the temperature of the magnetic yoke 4. This phenomenon is caused from various states that the magnetic yoke 4 comes into contact with the cooling block 1. On the other hand, in the magnetron of the present invention, since the magnetic yoke does not come into contact with the cooling block, the temperature of the magnetic yoke 20 is higher than that of the usual magnetron, however, the temperature is substantially the same as a maximum value of the unevenness of the temperature of the usual magnetron and hardly uneven.

As shown in FIG. 12, as for the temperature of the annular permanent magnet 8B, a difference hardly arises between the usual magnetron and the magnetron of the present invention. That is, the difference is hardly generated irrespective of the contact or non-contact of the magnetic yoke 4 and the cooling block 1.

As shown in FIG. 13, as for the temperature of the filter 11, the unevenness of the temperature arises in the usual magnetron similarly to the temperature of the magnetic yoke 4. As compared therewith, in the magnetron of the present invention, the temperature is substantially the same as a maximum value of the unevenness of the temperature of the usual magnetron and hardly uneven.

Namely, as can be understood from these graphs, when the gap is provided between the cooling block 22 and the magnetic yoke 20, the unevenness of the temperature can be more suppressed than the usual case that the cooling block 1 comes into closely contact with the magnetic yoke 4 and a larger influence is not given to the temperature of the annular permanent magnet 8 or the temperature of the filter 11.

Further, it is to be understood that an epoxy resin or silicone resin or a high thermally conductive resin such as a bio-plastic can be used as the cushioning material to improve a cooling effect.

As described above, according to the magnetron of this embodiment, the cooling block 22 does not come into closely contact with the magnetic yoke 20. The gap is provided between the cooling block 22 and the magnetic yoke 20 and the cushioning material 25 is interposed in the gap. The cooling block 22 is screwed to the magnetic yoke 20 through the cushioning material 25 so that the cooling block 22 is fixed relatively to the magnetic yoke 20. Accordingly, since the metals having a difference large in tendency of ionization are used for the cooling block 22 and the magnetic yoke 20, the corrosion of the metals hardly arise. Further, since the cushioning material 25 is provided between the cooling block 22 and the magnetic yoke 20, the impact or the vibration to the cathode structural member 13 of the anode tubular member 10 can be mitigated and the disconnection or deficiency of the filament of the cathode structural member 13 owing to the impact or the vibration can be reduced.

Further, even when there is a dimensional unevenness in the cooling block 22 or the magnetic yoke 20, since the cushioning material 25 absorbs it, the dimensional accuracy of the parts may not be required. Since the number of processes for improving the accuracy of the parts is not necessary, a cost can be the more lowered. Further, since the size of the cooling block 22 can be made to be smaller than that of a usual cooling block, the cost can be also decreased.

Further, since the cooling block 22 is fixed to the magnetic yoke 20 by the screws 24, even when the fastening parts 22*a* are unfastened by a thermal stress or vibration, the cooling block 22 can be prevented from being slipped off. Further, since the cooling block 22 does not come into contact with the magnetic yoke 20, unevenness in temperature of the magnetic yoke 20 due to a degree of contact does not arise and a prescribed quality can be maintained.

In the above-described embodiment, as the cushioning material 25 interposed in the gap between the cooling block 22 and the magnetic yoke 20, the resin material excellent in its impact resistance and vibration resistance such as nylon, Teflon (a registered trademark), Juracon (a registered trademark), urethane, rubber or the like is used, however, the present invention is not limited thereto, and any material excellent in its impact resistance and vibration resistance may be employed, such as plastics, ABS (Acrylonitrile Butadiene Styrene) resins, epoxy resins, silicone resins, mesh type metals, metals of low hardness, etc.

Figure 14A:
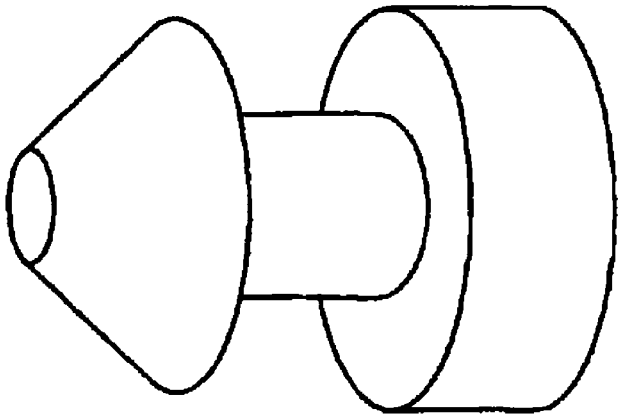
FIG. 14 is a view showing applied examples of the cushioning material of the magnetron according to the one embodiment of the present invention, which serve also as fixing members.
Figure 14B:
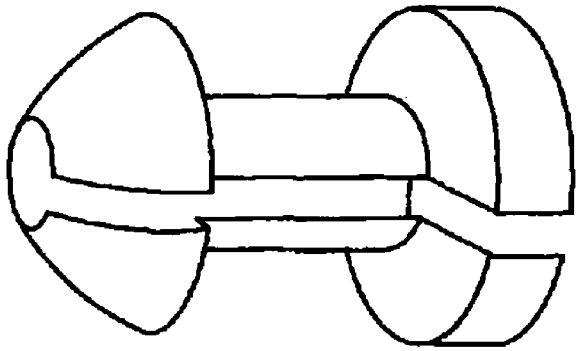

In the above-described embodiment, the cooling block 22 is screwed to the magnetic yoke 20 to relatively fix the cooling block and the magnetic yoke. However, a fixing member such as a rivet or a push pin (a hook part is widened and engaged with an object to be attached by inserting the push pin) and an anchor bolt may be used as well as the screw 24 to fix the cooling block relatively to the magnetic yoke. Further, as shown in FIG. 14, a cushioning material may serve also as a fixing member. The cushioning material shown in FIG. 14(*a*) is referred to as what is called a push pin and includes a cylindrical base end part, a tapered conical end part and a cylindrical connecting part for connecting the base end part to the end part. In this cushioning material of the push pin type, the end part is inserted into the hole of the cooling block 22 through the hole of the magnetic yoke 20 so that the magnetic yoke 20 can be fixed relatively to the cooling block 22 by one touch. Since the cushioning material of the push pin type serves also as the fixing member, the screw 24 is not necessary. Thus, the cost can be the more reduced. FIG. 14(*b*) shows a push pin having a slit passing through in the axial direction of the push pin the same as that shown in FIG. 14(*a*). Since the axially extending slit is provided, a hard material such as plastic can be used for the cushioning material. Since the cushioning material shown in FIG. 14(*a*) is not provided with the axially extending slit, a relatively soft material such as rubber can be used for the cushioning material.

Figure 15:
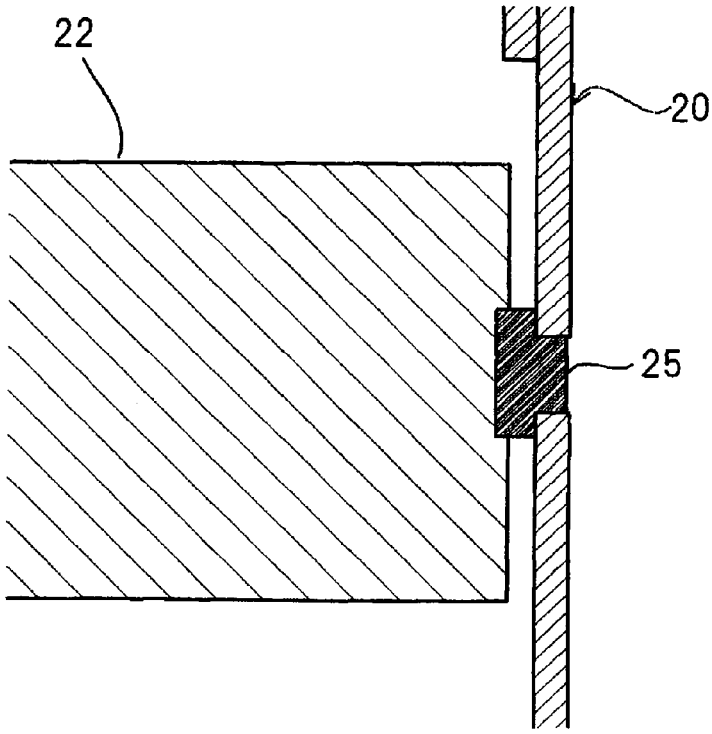
FIG. 15 is a sectional view showing a connecting part of the cooling block and the magnetic yoke when the applied example of the cushioning material of the magnetron according to the one embodiment of the present invention which serves also as the fixing member is used.
Figure 16:
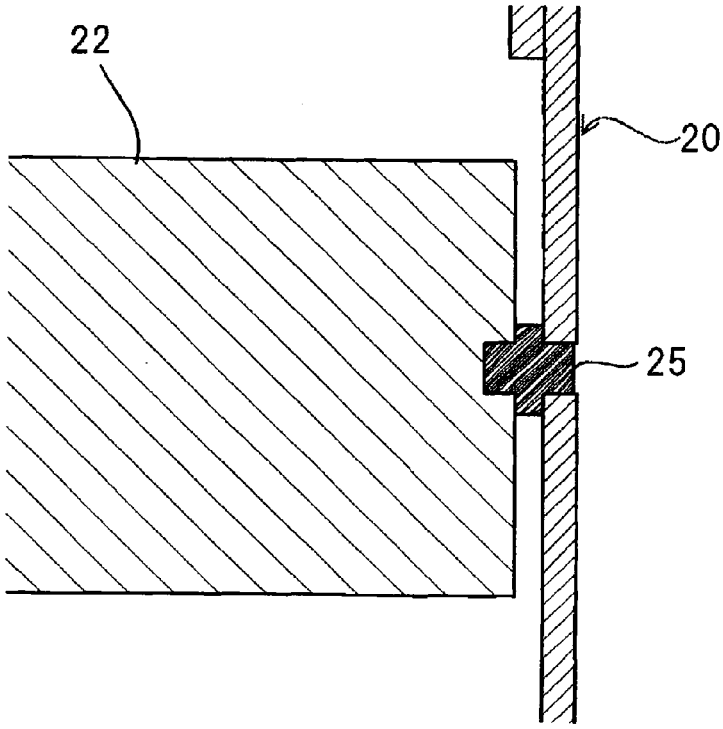
FIG. 16 is a sectional view showing a connecting part of the cooling block and the magnetic yoke when the applied example of the cushioning material of the magnetron according to the one embodiment of the present invention which serves also as the fixing member is used.

As the cushioning material, cushioning materials of a form shown in FIG. 15 or a form shown in FIG. 16 may be realized as well as the forms shown in FIG. 14. The cushioning material of the form shown in FIG. 15 is substantially the same as that shown in FIG. 5(*a*), however, a through hole is not formed. Further, the cushioning material of the form shown in FIG. 16 is substantially the same as that of FIG. 5(*d*), however, a through hole is not formed.

The present invention is useful for a magnetron effectively employed in a microwave using device such as a microwave oscillator that is excellent in its impact resistance and vibration resistance and easy in its assembly even when there is unevenness in dimension of a cooling block or a magnetic yoke and hardly generates a corrosion of metal.

What is claimed is:

1. A magnetron, comprising:

a cooling block that cools an anode tubular member having a cathode structural member and a magnetic yoke that accommodates the cooling block, wherein a gap is provided between the cooling block and the magnetic yoke and a cushioning material is provided in the gap to fix the cooling block and the magnetic yoke relatively by a fixing member.

2. The magnetron according to claim 1, wherein the cushioning material is interposed between the fixing member and the magnetic yoke to relatively fix the cooling block and the magnetic yoke by the fixing member.

3. The magnetron according to claim 1, wherein the cushioning material is formed to be longer than the thickness of the magnetic yoke, the magnetic yoke has a hole formed with a size through which the cushioning material can be inserted, and under a state that one end of the cushioning material is inserted into the hole, the cooling block is relatively fixed to the magnetic yoke through the cushioning material.

4. The magnetron according to claim 1, wherein the cushioning material serves also as the fixing member.

5. A device using a microwave that has the magnetron according to claim 1.

* * * * *